US005401898A

United States Patent [19]

Usa et al.

[11] Patent Number: 5,401,898

[45] Date of Patent: Mar. 28, 1995

[54] ELECTRONIC MUSICAL INSTRUMENT HAVING MULTIPLE PERFORMANCE FUNCTIONS

[75] Inventors: Satoshi Usa; Eiichiro Aoki, both of Hamamatsu, Japan

[73] Assignee: Yamaha Corporation, Hamamatsu, Japan

[21] Appl. No.: 161,174

[22] Filed: Dec. 3, 1993

Related U.S. Application Data

[63] Continuation of Ser. No. 884,055, May 5, 1992, abandoned, which is a continuation of Ser. No. 537,024, Jun. 11, 1990, abandoned.

[30] Foreign Application Priority Data

Jun. 12, 1989 [JP] Japan ..... 1-148826

[51] Int. Cl.[6] ..... G10H 1/053; G10H 1/18

[52] U.S. Cl. ..... 84/658; 84/DIG. 7

[58] Field of Search ..... 84/615, 622–628, 84/633, 653, 658–663, 665, 687–690, 692–700, 702–704, 711, DIG. 7, DIG. 10; 338/69

[56] References Cited

U.S. PATENT DOCUMENTS

| | | | |
|---|---|---|---|
| Re. 30,834 | 12/1981 | Niimi et al. | 84/DIG. 10 |
| 3,626,350 | 12/1971 | Suzuki | 338/69 |
| 4,621,557 | 11/1986 | Newell | 84/700 |
| 4,699,037 | 10/1987 | Minamitaka et al. | 84/658 |
| 4,817,484 | 4/1989 | Iba | 84/735 |
| 4,892,023 | 1/1990 | Takeuchi et al. | 84/687 |
| 4,919,032 | 4/1990 | Sakashita | 84/653 |
| 4,961,363 | 10/1990 | Mizuno et al. | 84/615 |
| 4,979,423 | 12/1990 | Watanabe | 84/690 |
| 4,993,307 | 2/1991 | Sakashita | 84/615 |
| 5,069,106 | 12/1991 | Sakashita | 84/626 X |
| 5,117,728 | 6/1992 | Shibukawa et al. | 84/633 |
| 5,160,798 | 11/1992 | Morikawa et al. | 84/615 |

*Primary Examiner*—Stanley J. Witkowski

*Attorney, Agent, or Firm*—Spensley Horn Jubas & Lubitz

[57] ABSTRACT

An electronic musical instrument includes an operator such as a bar-like touch operator having a play position to be designated, which play position is arranged in a predetermined direction thereof, a tone pitch designation circuit for generating tone pitch information corresponding to the play position, a tone generation designation operator such as keys in a keyboard for generating tone generation designation information in accordance with a tone generation designation operation, and a tone generator for generating a tone signal corresponding to the tone pitch information provided by the tone pitch designation operator in response to the tone generation designation information provided by the tone generation designation operator. A tone pitch is designated in response to a play position detected by the operator and a tone signal having the designated tone pitch is generated in accordance with operation of the tone generation designation operator whereby a variety of performance techniques which could not been simulated in conventional electronic musical instruments can be realized.

29 Claims, 6 Drawing Sheets

ELECTRONIC MUSICAL INSTRUMENT HAVING MULTIPLE PERFORMANCE FUNCTIONS

This is a continuation of application Ser. No. 07/884,055, filed May 15, 1992, now abandoned, which is a continuation of application Ser. No. 07/537,024, filed Jun. 11, 1990, now abandoned.

BACKGROUND OF THE INVENTION

This invention relates to a manually playable electronic musical instrument and, more particularly, to an electronic musical instrument of this type having an improved performance operator.

According to the invention, there are provided an operator such as a bar-like touch operator capable of detecting multiple play positions (touch positions) arranged in a predetermined direction (e.g., a longitudinal direction) of the operator, and a tone generation designation operator such as keys. Tone pitch is designated in response to a play position detected by the operator and a tone signal having the designated tone pitch is generated in accordance with the operation of the tone generation designation operator whereby the degree of freedom in the performance of the electronic musical instrument is improved.

A keyboard has generally been employed as a tone pitch designation means in an electronic musical instrument.

In an electronic musical instrument using a keyboard, one can play a normal music piece and glissando but cannot play portamento in which the tone pitch changes at a desired speed. For realizing such portamento performance, there has been proposed an electronic musical instrument in which a bar-like touch operator (called a "portamento bar") is provided and a continuous tone pitch change is realized by touching this bar-like operator in a sliding manner (e.g., U.S. Pat. No. 3,626,350).

According to the prior art portamento performance device, a tone is produced immediately upon start of touching on the portamento bar and the tone pitch of the tone changes as the touch position changes but, when the touch on the portamento bar has been released, the tone which has been produced starts to decay and it is not possible to start generation of a tone of the tone pitch corresponding to the touch release position from the beginning. Neither is it possible in the prior art device to start generation of a tone corresponding to a desired touch position from the beginning while the performer slides the touch position on the portamento bar. Expression technique by this prior art device therefore has to be limited.

It is an object of the invention to provide an electronic musical instrument having a larger degree of freedom of performance without such limitation.

SUMMARY OF THE INVENTION

The electronic musical instrument achieving the above described object of the invention comprises an operator capable of detecting multiple play positions arranged in a predetermined direction thereof, tone pitch designation means for generating tone pitch information corresponding to a play position defected by said operator, tone generation designation means for generating tone generation designation information in accordance with a tone generation designation operation, and tone generation means for generating a tone signal corresponding to the tone pitch information provided by said tone pitch designation means in response to the tone generation designation information provided by said tone generation designation means.

According to the invention, a desired tone pitch can be designated by the touch operation on the operator and a tone signal having the designated tone pitch can be generated in accordance with a tone generation designation operation independently of the touch operation on the operator. Accordingly, a tone of a tone pitch corresponding to a desired play position can be generated from the beginning at any desired timing in accordance with the play position on the operator and the tone generation designation operation on the tone generation designation means whereby a larger degree of freedom in the performance can be obtained and performances rich in variety can be realized.

For example, according to the invention, portamento can be performed in the same manner as in the prior art instrument by performing a tone generation designation operation substantially simultaneously with start of touching on the operator and, besides this performance, it is possible to start generation of a tone having a tone pitch corresponding to a desired touch position from the beginning by performing a tone generation designation operation in the course of sliding the touch position on the-operator or to start generation of a tone having a tone pitch corresponding to a touch releasing position from the beginning by performing a tone generation designation operation immediately before releasing of the touch on the operator.

In one aspect of the invention, a plurality of tone generation designation operators are provided for one operator so that a quick tremolo performance can be realized by designating a desired tone pitch by the operator and repeatedly operating the tone generation designation operators alternately.

In another aspect of the invention, a plurality of operators are provided and a tone signal is generated by a tone generation designation operation independently for each of these operators so that a performance effect simulating tones of plural strings as in a guitar or a violin can be obtained and a quick trill performance can be realized by designating desired tone pitches and repeating the tone generation designation operation alternately. In this case, a desired tone color may be set for each operator and tone signals may be generated with these set tone colors. A performance effect simulating an ensemble of musical instruments of different tone colors thereby can be obtained.

In another aspect of the invention, the tone pitch designation means generates a predetermined tone pitch information when-the operator is not operated so that a tone signal can be generated by operation of the tone generation designation means only and a tone of an open string as in a guitar can thereby be simulated. In this case, by setting a desired tone pitch and generating tone pitch information corresponding to the set tone pitch as the predetermined tone pitch information, a tone of a desired tone pitch can be produced as the tone of an open string.

In another aspect of the invention, interval information corresponding to a play position which has been detected by the operator is generated, a desired tone pitch is set and tone pitch information corresonding to the set tone pitch is generated and tone pitch information corresponding to the play position is generated by operating the interval information and the tone pitch information corresponding to the set tone pitch so that tone pitches which can be designated by the operator can be changed by merely changing the set tone pitch and an effect corresponding to transposition or tuning of a string can be obtained.

In another aspect of the invention, holding means for loading tone pitch information from the tone pitch designation means in response to load command information responsive to an operation on the operator and holding the tone pitch information even after release of the operation on the operator is provided and a tone signal corresponding to the tone pitch information from this holding means is generated in response to tone generation designation information and thereafter the generation of the tone signal is continued as long as the generation of the tone generation designation information is continued. According to this arrangement, a sustained tone can be produced by operating the operator for a moment for designating a tone pitch and ceasing the operation thereafter so that the performance operation can be facilitated.

In still another aspect of the invention, the operator can detect strength of operation at a desired play position in the predetermined direction on the operator, tone characteristic (e.g., tone color) control information corresponding to the detected strength of operation is generated, and the tone characteristic of a tone signal is controlled in accordance with this tone characteristic control information so that a tone which is rich in variety in its tone characteristics can be generated. In this case, by using tone generation designation means which can detect the strength of operation in response to a tone generation designation operation and controlling a tone characteristic (e.g., tone volume) of the tone signal in accordance with the detected strength of operation, a tone which is even richer in variety in its tone characteristics can be generated. The tone characteristic which is controlled in accordance with the strength of operation on the operator and the tone characteristic which is controlled in accordance with the strength of operation by the tone generation designation means are not limited to tone characteristics of different kinds such as tone color and tone volume but these tone characteristics may be of the same kind. As other tone characteristic controls, amounts of, for example pitch bend, vibrato and attack pitch may be controlled.

An embodiment of the electronic musical instrument according to the invention will now be described with reference to the accompanying drawings.

BRIEF DESCRIPTION OF THE DRAWINGS

In the accompanying drawings.

DESCRIPTION OF PREFERRED EMBODIMENTS

Figure 1A:
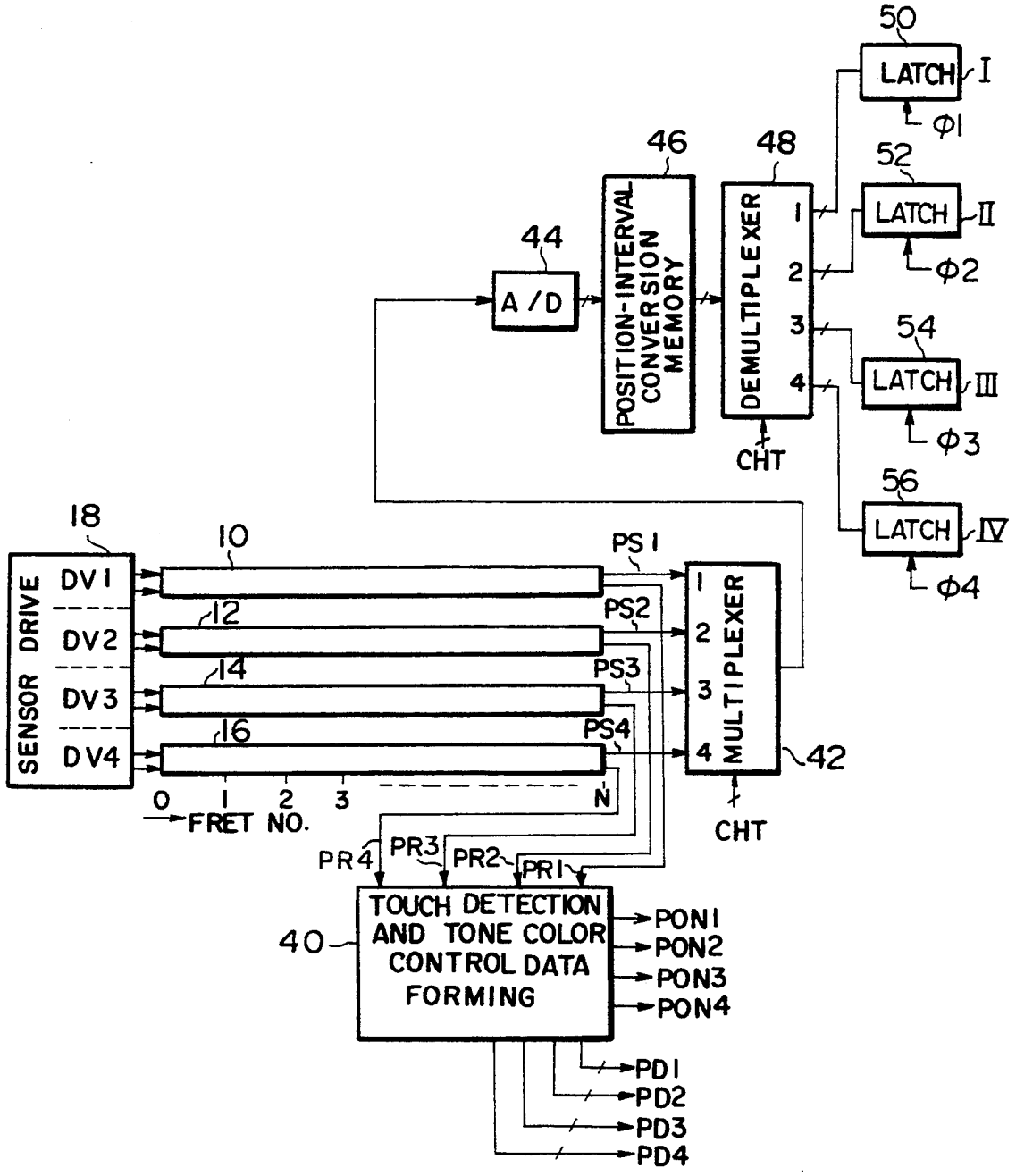
FIGS. 1A and 1B are block diagrams showing an embodiment of the electronic musical instrument of the invention.
Figure 1B:
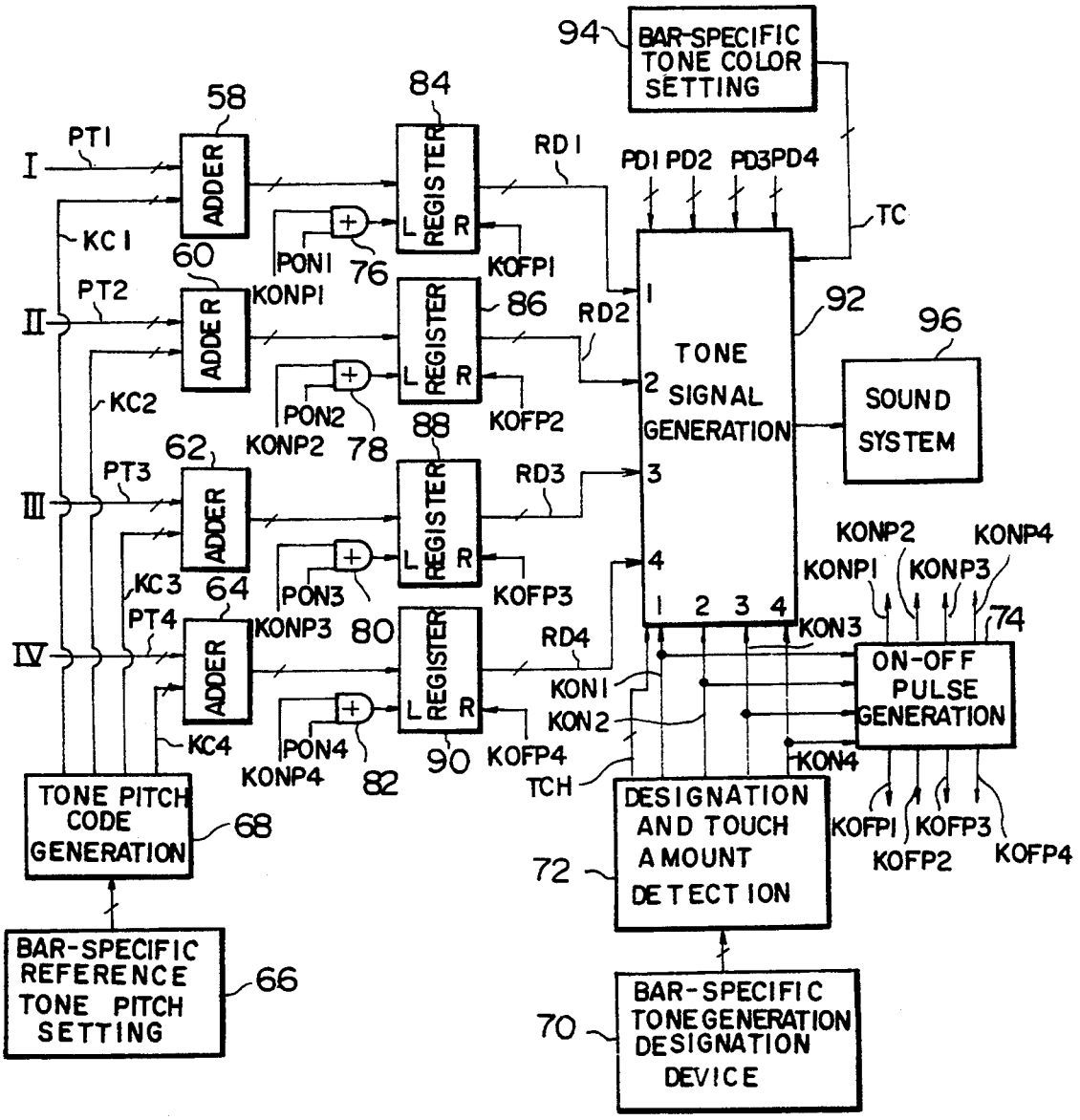

FIGS. 1A and 1B show an embodiment of the electronic musical instrument according to the invention. In the figure, each signal line shown as a broad arrow line represents plural signal lines or indicates that the signal line transmits data of plural bits.

Touch bars 10, 12, 14 and 16 are provided in parallel to one another in a neck portion of a performance instrument having a shape which resembles, for example, a guitar or a violin. Each of these touch bars 10, 12, 14 and 16 is provided with a position sensor for detecting any of touch positions (play positions) arranged in the longitudinal direction of the touch bar and also with a pressure sensor for detecting a touch pressure at the touch position.

The four sets of the position-pressure sensors of the touch bars 10 through 16 are driven by four drive units DV1 through DV4.

Figure 2:
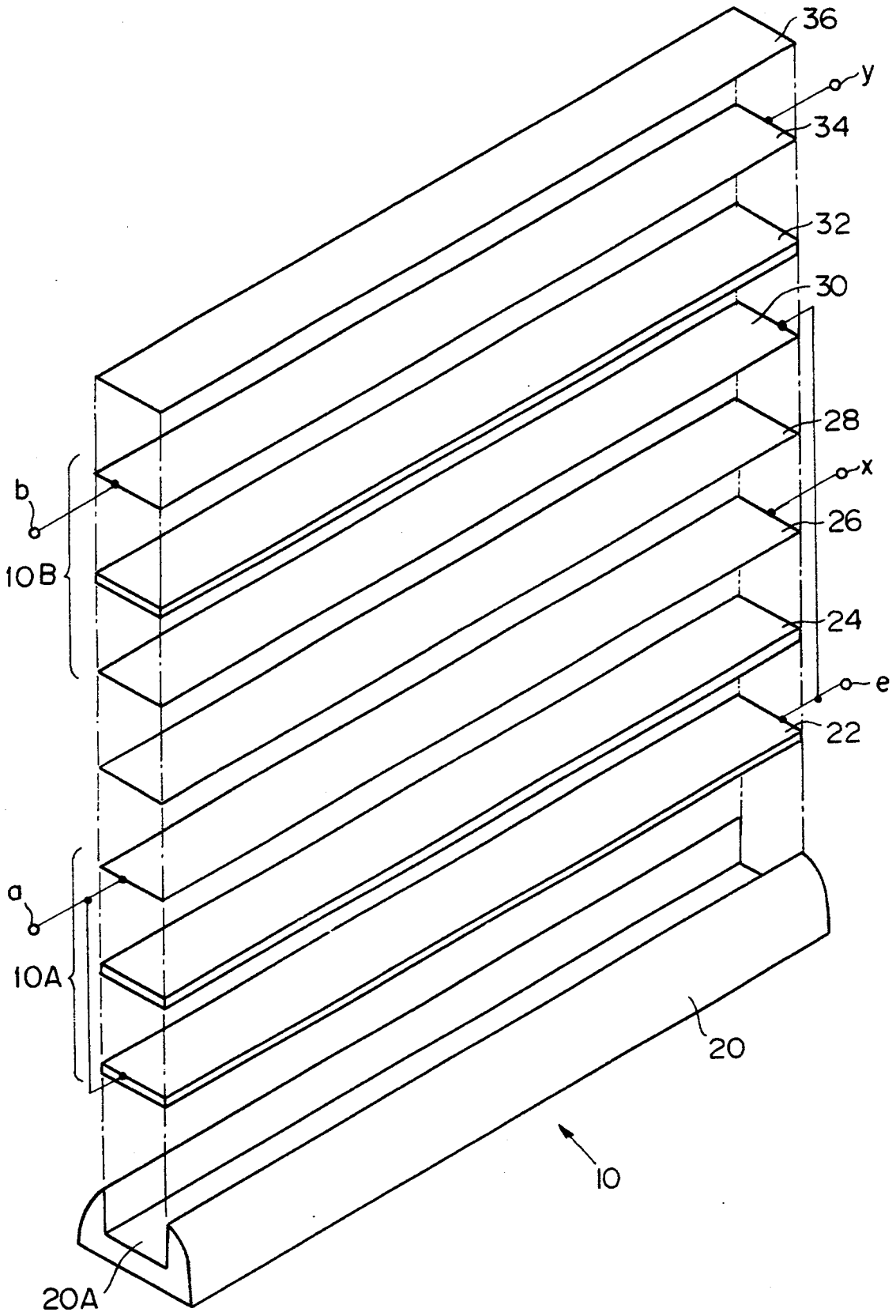
FIG. 2 is an exploded perspective view of a touch bar.

The touch bars 10 through 16 are of the same structure and an example of the structure of the touch bar 10 is representatively shown in FIG. 2.

In FIG. 2, a case 20 made of an insulating material such as plastics is formed with a groove 20A in which a uniform resistance sheet 22, a pressure sensitive conductive sheet 24, a conductive film 26, an insulating film 28, a conductive film 30, a pressure sensitive resistance sheet 32, a conductive film 34 and a cover 36 of an insulating material are superposed one upon another from the bottom upwardly.

The uniform resistance sheet 22, pressure sensitive conductive sheet 24 and conductive film 26 constitute a position sensor 10A. A drive terminal a is connected to one end of the sheets 22 and 26 and an earth terminal e is connected to the other end of the sheet 22 and an output terminal x is connected to the other end of the sheet 26. As electric conductivity increases at any touch position arranged in the longitudinal direction of the touch bar 10, the pressure sensitive conductive sheet 24 provides a conductive path corresponding to the touch position between the uniform resistance sheet 22 and the conductive film 26.

The conductive film 30, pressure sensitive resistance sheet 32 and conductive film 34 constitute a pressure sensor 10B. The pressure sensor 10B is electrically insulated from the position sensor 10A by the insulating film 28. A drive teriminal b is connected to an-end of the conductive film 34 and an output terminal y is connected to the other end thereof. An earth terminal e is connected to the end of the conductive film 30 corresponding to the other end of the conductive film 34. In the pressure sensitive resistance sheet 32, the value of resistance decreases as the touch pressure increases at any touch position.

Figure 3:
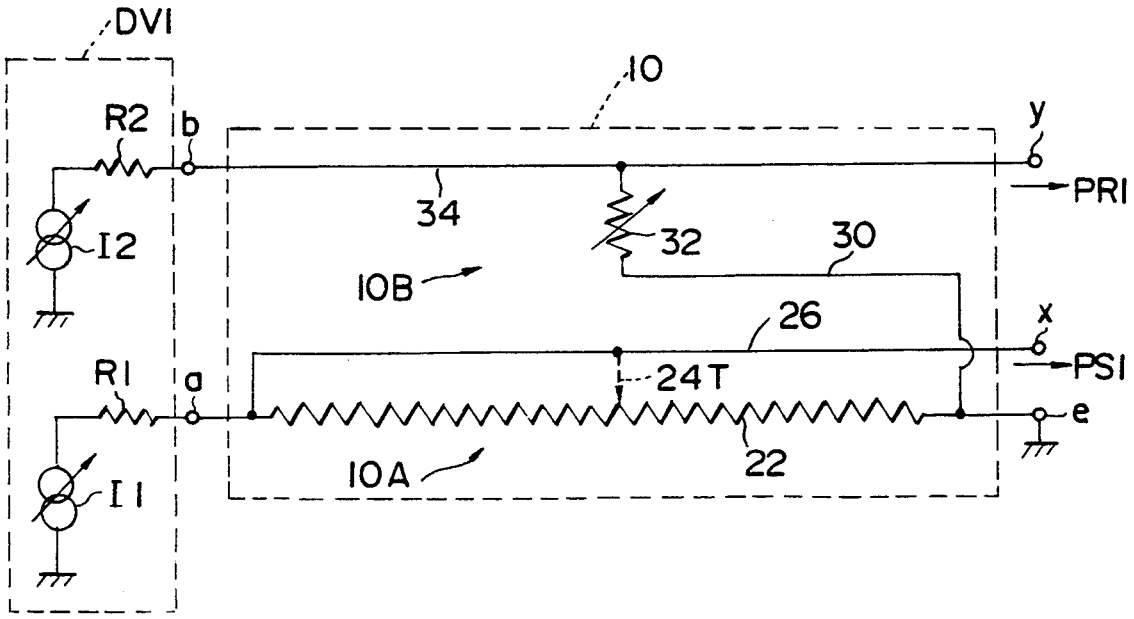
FIG. 3 is a circuit diagram showing an example of a sensor driving circuit.

The drive units DV1 through DV4 of the sensor drive circuit 18 are of the same structure and an example of the structure of the drive unit DV1 is representatively shown with an equivalent circuit of the touch bar 10 in FIG. 3.

In FIG. 3, to the drive terminal a of the position sensor 10A is connected to one terminal of a constant current source 11 of a variable current value through a resistance R1. The other terminal of the constant current source 11 is connected to a reference potential. The earth terminal e of the touch bar 10 is also connected to a reference potential.

To the drive terminal b of the pressure sensor 10B is connected to one terminal of a constant current source 12 of a variable current value and the other terminal of the constant current source 12 is connected to a reference potential.

When the touch bar 10 is touched by a finger or the like at any of positions arranged in the longitudinal direction of the touch bar 10, a portion 24T of the pressure sensitive conductive sheet 24 in the position sensor 10A corresponding to the touch position is brought into conduction. A voltage corresponding to the resistance value from the portion 24T to the terminal e therefore is provided from the output terminal x as a touch position signal PS1.

In the pressure sensor 10B, the resistance value in a portion of the pressure sensitive resistance sheet 32 corresponding to the touch position is reduced in response to the touch pressure and a voltage corresponding to the resistance value between the terminals y and e is provided from the output terminal y as a touch pressure signal PR1.

Likewise, touch position signals PS2 through PS4 and touch pressure signals PR2 through PR4 are provided from the other touch bars 12 through 16 in the same manner as in the touch bar 10.

Reverting to FIG. 1A, the touch pressure signals PR1 through PR4 provided by the touch bars 10 through 14 are supplied to a touch detection and tone color control data forming circuit 40. The circuit 40 detects, for example, that the value of each of the signals PR1 through PR4 has reached a predetermined value and thereupon generates ON signals PON1 through PON4 representing presence of touch on the corresponding touch bar respectively for the signals PR1 through PR4. The circuit 40 generates also tone color control data PD1 through PD4 respectively for the signals PR1 through PR4 by analog-to-digital converting these signals PR1 through PR4 and subjecting them to a tone color control data conversion processing.

Figure 4:
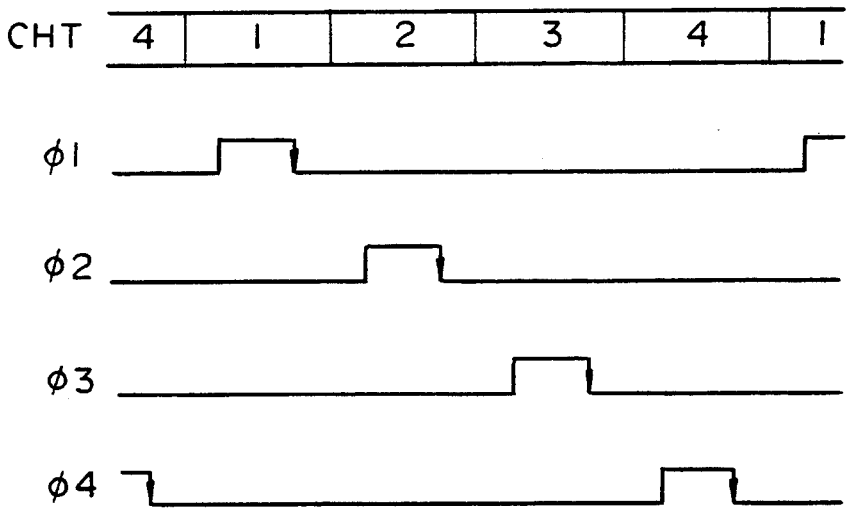
FIG. 4 is a time chart for explaining the operation of latch circuits 50 through 55.

The touch position signals PS1 through PS4 are applied to a multiplexer 42 as its inputs 1 through 4. The multiplexer 42 outputs the signals of the inputs 1 through 4 sequentially and repeatedly in response to a channel timing signal CHT which designates, as shown in FIG. 4, the first through fourth channels sequentially and repeatedly. The outputs of the multiplexer 42 is supplied to an analog-to-digital conversion circuit 44 as an analog input.

The analog-to-digital conversion circuit 44 converts the analog input supplied thereto to digital data and supplies the digital data to position-interval conversion memory 46.

As shown in FIG. 1, fret positions indicated by numbers 0 through N are determined on the touch bars 10 through 16.

The touch position signals PS1 through PS4 provided by the touch bars 10 through 16 are time division multiplexed by the multiplexer 42 and applied to the analog-to-digital conversion circuit 44 at each touch bar time channel (see FIG. 4) to be converted to digital position data. The digital position data corresponds linearly to touch positions on each touch bar. Assuming, for example, that the digital position data consists of 12 bits, it assumes a value from 0 to 4095 on the touch bar between ends thereof.

The position data thus obtained is applied on a time shared basis to the position-interval conversion memory 46 as address signals and this converson memory 46 thereupon provides corresponding interval data on a time shared basis. The conversion memory 46 stores a smooth curve which rises by a semitone at each fret position 0, 1, . . . .

The data read from the memory 46 is supplied to a demultiplexer 48. The demultiplexer 48 distributes its input data to latch circuits 50, 52, 54 and 56 sequentially and repeatedly in response to the channel timing signal CHT. In the latch circuits 50 through 56, as shown in FIG. 4, their input data are latched in synchronism with falling of latch command signals $\phi$1 through $\phi$4 corresponding to the first through fourth channels. Since the multiplexer 42 and the demultiplexer 48 are operated in synchronism with each other at each channel, interval data PT1 through PT4 corresponding to the touch bars 10, 12, 14 and 16 are respectively latched by the latch circuits 50, 52, 54 and 56. These interval data PT1 through PT4 are supplied to corresponding addition circuits 58, 60, 62 and 64 in FIG. 1B.

In FIG. 1B, a bar-specific reference tone pitch setting device 66 is provided for setting, for each touch bar independently, a desired reference tone pitch corresponding to the fret position 0 by a switch operation or the like operation.

A reference tone pitch code generation circuit 68 generates reference tone pitch code data representing the reference tone pitch set for each touch bar by the reference tone pitch setting device 66. Tone pitch code data KC1 through KC4 corresponding to the touch bars 10 through 16 are supplied to the addition circuits 58, 60, 62 and 64 and added to the interval data PT1 through PT4.

Assuming, for example, that a reference tone pitch C2 has been set for the touch bar 10, the outputs of the addition circuit 58 have tone pitches C2, C2#, D2, D2# . . . in correspondence to the fret numbers 0, 1, 2, 3 . . . . Assuming, for another example, that a reference tone pitch G2 has been set, tone pitches G2, G2#, A2, A2# . . . are obtained in correspondence to the fret numbers 0, 1, 2, 3 . . . . This operation which corresponds to tuning of a string can be applied to the other touch bars.

The bar-specific tone generation designation device 70 performs the tone designation operation for each of the touch bars 10, 12, 14 and 16 and is constructed, for example, as shown in FIGS. 5A through 5E.

Figure 5A:
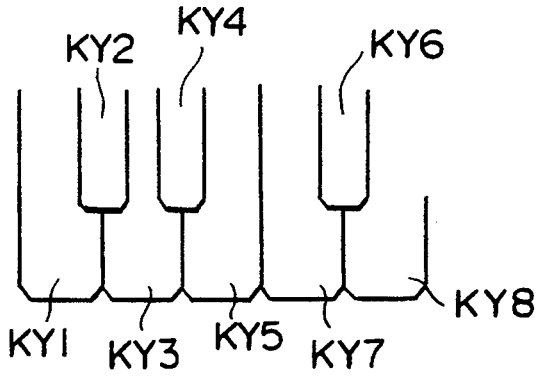
FIGS. 5A through 5E are diagrams showing examples of tone generation designation devices for each bar.

FIG. 5A shows an example of the device 70 which employs a keyboard having keys KY1 through KY8. In this keyboard, a key switch and a touch sensor are provided for each key. The key switch detects presence or absence of depression of a corresponding key (i.e., tone generation designation) and the touch sensor detects a touch amount, i.e., strength or speed of touch in the depression of a key by means of a system which is well known. In this example, one key may be provided in correspondence for each touch bar or, alternatively, plural keys may be provided in correspondence to each touch bar in such a manner that, for example, the keys KY1 and KY2 are provided for the touch bar 10, the keys KY3 and KY4 are provided for the touch bar 12 and so on. The latter arrangement is convenient for realizing a quick tremolo performance or a quick trill performance. For example, by depressing the keys KY1 and KY2 quickly and alternately in a state in which a desired tone pitch has been designated on the touch bar 10, tremolo can be performed much faster than in a conventional keyboard musical instrument. For another example, by depressing the keys KY2 and KY3 quickly and alternately in a state in which desired two tone pitches have been designated on the touch bars 10 and 12, a trill performance of the two desired tones can be made at a high speed.

Figure 5B:
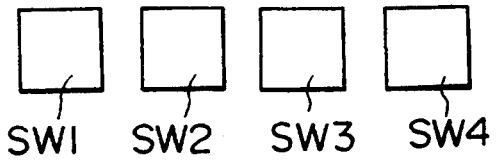
Figure 5C:
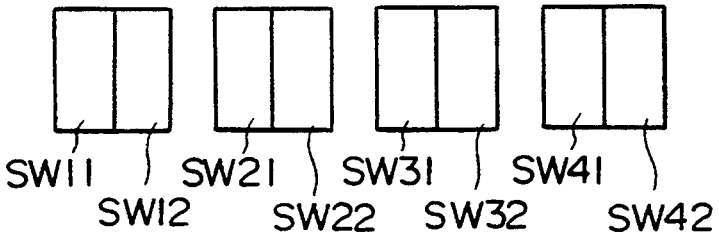

FIGS. 5B and 5C show examples of the device 70 which employ self-return type push-button switches. FIG. 5B shows an example in which switches SW1 through SW4 are provided in correspondence to the touch bars 10 through 16. FIG. 5C shows an example in which switches SW11 and SW12 through SW41 and SW42 are provided for the touch bars 10 through 16 with a ratio of two swithces for one touch bar. In these cases, a touch sensor may be provided for each switch.

The keyboard or the switch group shown in FIGS. 5A through 5C may be provided in a part of the performance instrument which is easy for manipulation, e.g., a body portion of the performance instrument having a shape resembling a guitar or a violin.

Figure 5D:
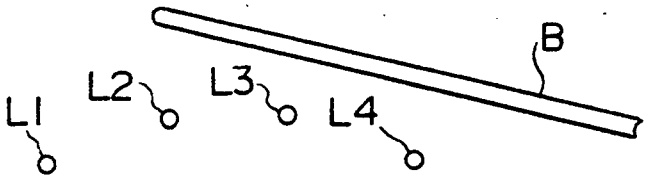
Figure 5E:
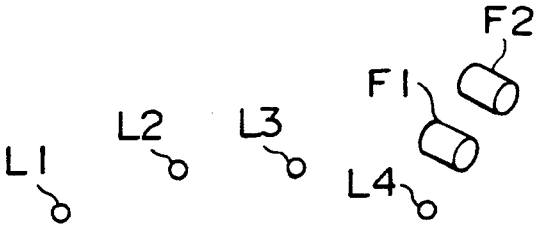

FIGS. 5D and 5E show examples in which strings L1 through L4 are stretched along the corresponding touch bars 10 through 16 in a neck portion of the performance instrument having a shape resembling a guitar or a violin.

In the example of FIG. 5D, the tone generation designation operation is made by using a bow B. By constructing the bow B utilizing the principle of the pressure sensor shown in FIG. 2, both the tone generation designation information and the touch amount information can be detected. In case the tone generation designation information only needs to be detected, the bow may be constructed by utilizing the principle of the position sensor shown in FIG. 2 or, alternatively, a detection switch may be composed of each string and the bow.

Touch amount information may be produced by forming velocity information by differentiating the position information provided by the position sensor and multiplying this velocity information with the pressure information provided by the pressure sensor and the tone generation designation information may be generated when the touch amount information has exceeded a predetermined level.

In the example of FIG. 5E, finger-rings F1 and F2 are employed for performing the tone generation designation operation. These finger-rings may be constructed in the same manner as in the example of FIG. 5D or, alternatively, a switch may be composed of each string and each finger-ring. By using two finger-rings, performance of tremolo or trill can be facilitated but only one finger-ring may be used instead of two.

Reverting to FIG. 1, a designation and touch amount detection circuit 72 detects the tone generation designation operation by the tone generation designation device 70 and the-touch amount in the tone generation designation operation and generates a tone generation designation signal and a touch amount signal for each of the touch bars 10 through 16. The circuit 72 supplies tone generation designation signals KON1 through KON4 corresponding to the respective touch bars 10 through 16 to an on-off pulse generation circuit 74 and a tone signal generation circuit 92.

Figure 6:
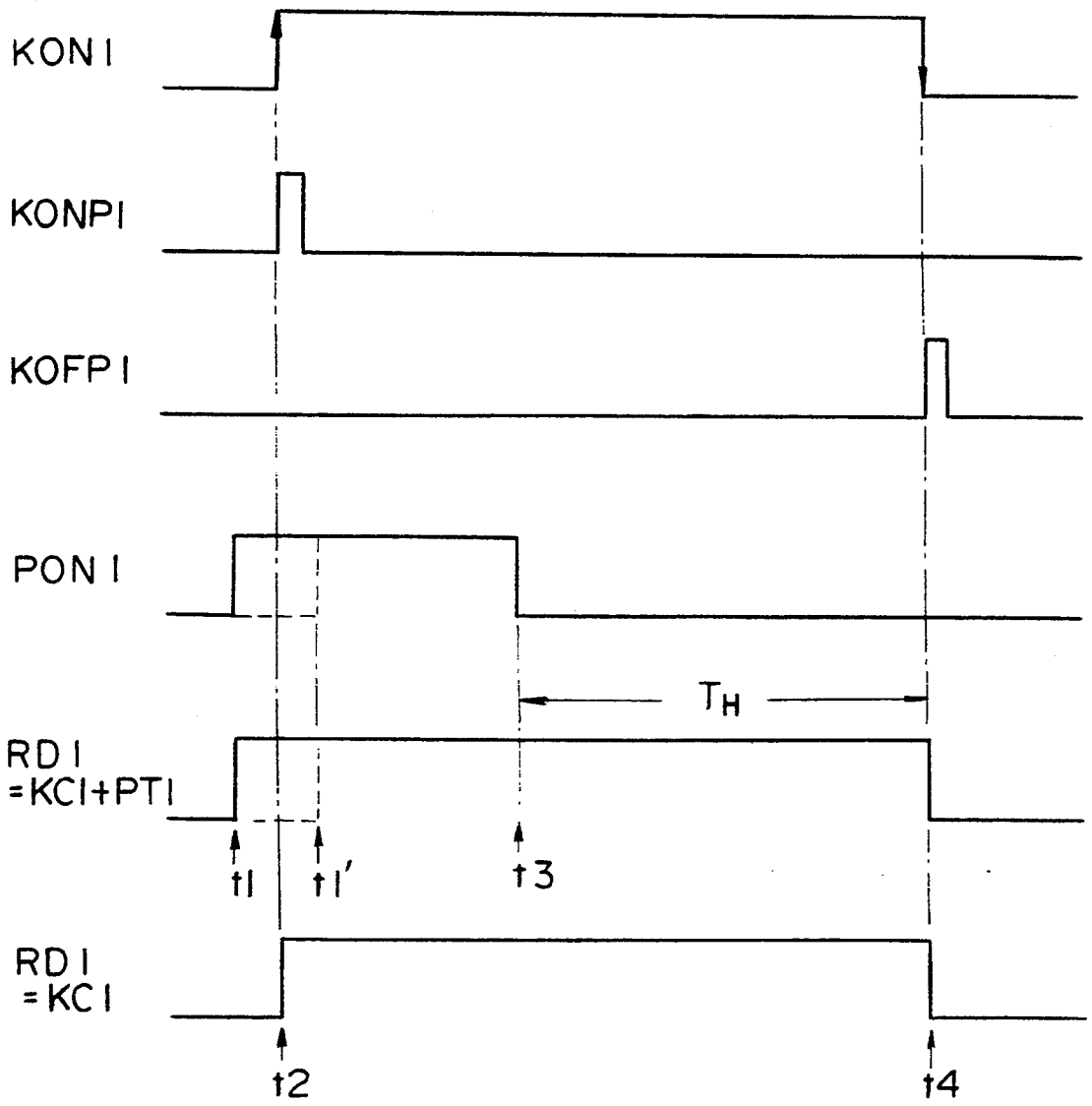
FIG. 6 is a time chart for explaining the operation of a register 84.

The on-off pulse generation circuit 74 includes a rise differentiation circuit and a fall differentiation circuit for each tone generation designation signal and generates an ON pulse KONP1 and an OFF pulse KOFP1 in response to a tone generation designation signal KON1 as shown in FIG. 6. The circuit 74 likewise generates ON pulses KONP2 through KONP4 and OFF pulses KOFP2 through KOFP4 in response to tone generation designation signals KON1 through KON4.

OR gates 76, 78, 80 and 82 receive the ON signals PON1, PON2, PON3 and PON4 from the circuit 40 as one input thereof and the ON pulses KONP1, KONP2, KONP3 and KONP4 from the circuit 74 as another input thereof and provide respective output signals corresponding to these input signals to registers 84, 86, 88 and 90 as load signals L. To the registers 84, 86, 88 and 90 are also supplied the OFF pulses KOFP1, KOFP2, KOFP3 and KOFP4 from the circuit 74 as reset signals R.

Output data RD1 through RD4 of the registers 84 through 90 are supplied to the first through fourth tone forming channels in the tone signal generation circuit 92. These first through fourth tone forming channels are provided for generating tone signals in correspondence to the touch bars 10 through 16. These tone forming channels may be either provided in parallel or constructed in a time sharing fashion.

To the first through fourth tone forming channels are supplied the tone generation designation signals KON1 through KON4 and the touch amount signal TCH corresponding to the touch bars 10 through 16 from the circuit 72.

A bar-specific tone color setting device 94 sets a desired tone color for each of the touch bars 10 through 16 by a switch operation or the like operation and supplies tone color data TC indicating a set tone color for each of the touch bars 10 through 16 to the first through fourth tone forming channels of the tone signal generation circuit 92. To the first through fourth tone forming channels are also supplied the tone color control data PD1 through PD4 from the touch detection and tone color control data forming circuit 40 so that the set tone color can be changed in accordance with the touch pressure with respect to each touch bar.

The tone color setting device 94 may set a single tone color such as a guitar tone color for all of the touch bars 10 through 16 or may set different tone colors such as violin, viola, cello and bass tone colors respectively for the touch bars 10, 12, 14 and 16. By setting such different tone colors, a performance simulating an ensemble of these musical instruments can be realized.

A tone signal from the circuit 92 is supplied to a sound system including an output amplifier and loudspeakers and propagated therefrom as a sound.

Since the tone signal generation operation in the first through fourth tone forming channels is the same through these channels, the tone signal generation operation in the first tone forming channel will be representatively described with the operation of the register 84 in conjunction with FIG. 6.

As the touch bar 10 is touched at any desired position in the longitudinal direction thereof, the ON signal PON1 rises from the low level to the high level and tone pitch data (KC1+PT1) representing tone pitch corresponding to the touch position is provided from the addition circuit 58 at, for example, a time point t1. This tone pitch data is loaded in the register 84 in response to the ON signal PON1. Thereafter, upon release of the touch on the touch bar 10 at a time point t3, for example, the ON singal PON1 falls to the low level but the register 84 holds the previously loaded tone pitch data even after this time point t3.

On the other hand, upon performing the tone generation designation operation for the touch bar 10 in the tone generation designation device 70 in association with the touch on the touch bar 10 at a time point t2, for example, the tone generation designation signal KON1 rises from the low level to the high level and the ON pulse KONP1 is generated in response thereto. This ON pulse KONP1 is supplied to the register 84 but the contents of the register 84 remains unchanged.

In the first tone forming channel, generation of a tone signal having tone pitch corresponding to the tone pitch data (KC1+PT1) is started in synchronism with rising of the tone signal designation signal KON1. The tone signal generated at this time is controlled in its tone color in response to the tone color data TC from the tone color setting device 94 and the tone color control data PD1 from the touch detection and tone color control data forming circuit 40 and is controlled in its tone volume in response to the touch amount signal TCH from the designation and touch amount detection circuit 72. Even after start of generation of the tone, its tone color can be subtly changed in response to the data PD1 by changing the touch pressure on the touch bar 10 and its tone volume can also be subtly changed in response to the signal TCH by changing the touch amount in the tone generation designation device 70. Accordingly, a sustained tone which is rich in variety can be generated.

Then, when the tone generation designation operation in the tone generation designation device 70 has ceased, the tone generation designation signal KON1 falls from the high level to the low level at a time point t4, for example, and the OFF pulse KOFP1 is generated in response thereto. This OFF pulse KOFP1 resets the register 84. The tone signal generation circuit 92 starts decaying of the tone signal with the tone pitch at the time point t4 in synchronism with falling of the signal KON1.

By providing the register 84 for holding the tone pitch data during the period TH from release of the touch till stop of the tone generation designation, the generation of the tone signal can be continued during the tone generation designation operation without continuing touching on the touch bar whereby the performance operation can be facilitated.

The foregoing description has been made about the tone generation operation which is performed when the tone generation designation operation has been made in association with touching on the touch bar. In a case where the tone generation designation operation has been made without touching on the touch bar, the tone generation operation will be performed in the following manner.

When the tone generation designation signal KON1 has risen at a time point t2, for example, in accordance with the tone generation designation operation and the ON pulse KONP1 has been generated, the tone pitch data KC1 corresponding to the fret 0 of the touch bar 10 supplied to the register 84 from the addition circuit 58 is loaded in the register 84. In the first tone forming channel, therefore, generation of a tone signal having tone pitch corresponding to the tone pitch data KC1 is started in response to the tone generation designation signal KON1. At this time, the tone color of the tone signal is controlled in accordance with the tone color data TC and the tone color control data PD1 and the tone volume of the tone signal is controlled in accordance with the touch amount signal TCH in the same manner as previously described.

Upon stopping of the tone generation designation operation at a time point t4, for example, the signal KON1 falls and the tone signal starts to decay in response thereto. Simultaneously, the register 84 is reset by the OFF pulse KOFP1.

By adopting the above described arrangement according to which tone pitch data is provided from the circuit 58 without touching on the touch bar 10, generation of an open string tone in a string instrument such as a guitar can be simulated. Since the tone pitch of the reference tone pitch data KC1 can be determined as desired by the tone pitch setting device 66, a tone can be generated at any desired tone pitch.

As an operation different from the above described operations, the tone generation operation in a case where the touch bar has been touched after performing the tone generation designation operation will be as follows.

When the tone generation designation signal KON1 has risen at a time point t2, for example, in accordance with the tone generation designation operation and the ON pulse KONP1 has been generated, a tone signal having tone pitch corresponding to the fret 0 on the touch bar 10 is generated in the same manner as described above. Thereafter, upon rising of the ON signal PON1 at a time point t1', for example, in accordance with the touch operation on the touch bar 10, tone pitch data (KC1+PT1) corresponding to the touch position is loaded in the register 84 in response to the signal PON1. Assuming that the touch bar has been touched at the position of fret 1, the tone pitch of the tone signal which is being generated rises by a semiton from the time point at which the tone pitch data (KC1+PT1) has been loaded in the register 84. The subsequent decay start operation upon stopping the tone generation designation operation is the same as the one described above.

Portamento can be performed by touching at the position of fret 1 on the touch bar 10, for example, and simultaneously performing the tone generation designation operation by the tone generation designation device 70 and thereafter sliding the touch position from fret 1 to fret 2. By this operation, the tone pitch of a generated tone rises smoothly from one corresponding to fret 1 to one corresponding to fret 2. The tone pitch can be caused to fall by reversing the direction of sliding of the touch position.

By sequentially performing the tone generation designation operation in the tone generation designation device 70 while sliding the touch position on the touch bar 10, tones having tone pitches corresponding to current touch positions at the respective tone generation designation operations are generated from the beginning at each tone generation designation operation. Further, by performing portamento by sliding the touch position from fret 1 to fret 2, for example, and stopping the tone generation designation operation immediately before the end of the portamento performance and then immediately starting the tone generation designation operation again, a tone corresponding to fret 2 can be generated from the beginning.

The invention is not limited to the above described examples but may be implemented in numerous ways including the following modified forms:

(1) As the tone pitch designating operator, not only the touch bar but other operators such as a slide volume which can obtain position information corresponding to positions may be used.

(2) Instead of resetting the registers 84 through 90 of FIG. 1 by the OFF pulse KOFP, tone pitch after release of the tone generation designation operation may be changed by operating the operator such as the touch bar. By this modification, a portamento effect can be imparted also to a tone after release.

(3) As the tone generation designation means, devices other than the devices shown in FIGS. 5A through 5E, e.g., a press sensor, drum pad or foot switch may be used.

(4) As the position-interval conversion memory 46 of FIG. 1, a stepwise characteristic having a flat portion of a predetermined width at each fret position in the relation between the operation position and the output may be employed instead of the characteristic in which the operation position corresponds linearly to the output.

(5) When the signal PON generated by the operation of the touch bars 10 through 16 of FIG. 1 has become 0, the tone pitch immediately before this time point may be held in the registers 84 through 90 and the tone color may be changed. By this arrangement, a characteristic according to which the tone color changes subtly when a string has been opened in a string instrument can be simulated.

What is claimed is:

1. An electronic musical instrument comprising:

a plurality of touch-sensitive operators each having a plurality of designatable play positions;

tone pitch designation means for generating tone pitch information corresponding to a designated one of the plurality of play positions of each of said plurality of operators while simultaneously detecting touch of each of said plurality of operators, wherein the tone pitch designation means generates the tone pitch information from a plurality of adjacent tone pitches based on a correspondence between the designated one of the plurality of play positions and at least one of the plurality of adjacent tone pitches;

tone generation designation means for generating tone generation designation information for each of said plurality of operators in accordance with a tone generation designation operation, the tone generation designation means being operative independently of the tone pitch designation means and the plurality of touch-sensitive operators; and tone generation means for generating a tone signal for each of said operators in response to the tone generation designation information provided by said tone generation designation means, and in accordance with respective tone pitch information corresponding to each of said plurality of operators provided by said tone pitch designation means.

2. An electronic musical instrument as defined in claim 1 further comprising tone color setting means for setting a desired tone color for each of said plurality of operators, wherein each tone signal generated by said tone generation means is imparted with a tone color set by said tone color setting means for each of said operators.

3. An electronic musical instrument as defined in claim 1, wherein said tone generation designation means includes a plurality of switches.

4. An electronic musical instrument comprising:

a plurality of touch-sensitive operators each having a plurality of designatable play positions;

tone pitch designation means for generating tone pitch information corresponding to a designated one of the plurality of play positions of each of said plurality of operators while simultaneously detecting touch of each of said plurality of operators;

tone generation designation means, provided for each of the plurality of touch-sensitive operators, for generating tone generation designation information for each of said plurality of operators in response to a tone generation designation operation, the tone generation designation means being operative independently of the tone pitch designation means and the plurality of touch-sensitive operators; and tone generation means for generating a tone signal for each of said operators in response to the tone generation designation information provided by said tone generation designation means, wherein each tone signal is generated in accordance with respective tone pitch information corresponding to each of said plurality of operators provided by said tone pitch designation means, and wherein said tone generation designation means comprises a plurality of tone generation designation operators each of which generates tone generation designation information in accordance with a tone generation designation operation.

5. An electronic musical instrument as claimed in claim 4 wherein said tone pitch designation means comprises:

interval information generation means for generating interval information corresponding to a play position detected by said operator;

reference tone pitch setting means for setting a reference tone pitch and generating reference tone pitch information corresponding to the set reference tone pitch; and tone pitch information generation means for generating tone pitch information corresponding to a designated play position on said operator in accordance with the interval information from said interval information generation means and the reference tone pitch information from said reference tone pitch setting means.

6. An electronic musical instrument as defined in claim 4, further comprising:

performance operation detection means for generating load command information in response to an operation of at least one of said plurality of operators; and holding means responsive to the load command information for loading and outputting the tone pitch information provided by said tone pitch designation means and continuing output of the tone pitch information after the operation of said at least one operator, wherein said tone generation means generates at least one tone signal in response to the tone generation designation information from said tone generation designation means and continues the generation of the at least one tone signal as long as the generation of the tone generation designation information continues.

7. An electronic musical instrument as defined in claim 4 wherein each of said plurality of operators is capable of detecting a strength of operation at any of the designatable play positions, wherein the musical instrument further comprises information generation means for generating tone characteristic control information corresponding to the strength of the operation detected by each of said plurality of operators, the tone characteristic of tone signals generated by said tone generation means being controlled in accordance with the tone characteristic control information provided by said information generation means.

8. An electronic musical instrument as defined in claim 7 wherein said tone generation designation means is capable of detecting the strength of operation of each of said plurality of operators and said tone generation means controls the tone characteristic of the tone signal in accordance with the strength of the operation detected by said tone generation designation means.

9. An electronic musical instrument comprising:

a plurality of operators each having at least one designatable play position;

tone pitch designation means for generating tone pitch information corresponding to a designated play position of each of said plurality of operators;

tone generation designation means for generating tone generation designation information for each of said plurality of operators in response to a tone generation designation operation; and tone generation means for generating a tone signal for each of said operators in response to the tone generation designation information provided by said tone generation designation means, wherein each tone signal is generated in accordance with respective tone pitch information corresponding to each of said plurality of operators provided by said tone pitch designation means, wherein said tone pitch designation means generates predetermined tone pitch information for each of said plurality of operators when said operators are not operated.

10. An electronic musical instrument as defined in claim 9 wherein said tone pitch designation means includes tone pitch setting means for setting said predetermined tone pitch information.

11. An electronic musical instrument comprising:

a plurality of operators each having at least one designatable play position, wherein operation of each of said plurality of operators produces a respective plurality of position signals indicative of the at least one designatable play position of each of said plurality of operators;

tone pitch designation means for generating tone pitch information corresponding to a designated play position of each of said plurality of operators;

tone generation designation means for generating tone generation designation information for each of said plurality of operators in response to a tone generation designation operation;

tone generation means for generating a tone signal for each of said operators in response to the tone generation designation information provided by said tone generation designation means, wherein each tone signal is generated in accordance with respective tone pitch information corresponding to each of said plurality of operators provided by said tone pitch designation means;

converting means for converting the plurality of position signals into a corresponding plurality of note interval difference signals, adding means for respectively adding the note interval difference signals to a predetermined offset signal to produce a plurality of tone generation signals, and a tone generator responsive to each of the plurality of tone generation signals for producing a corresponding plurality of tones.

12. An electronic musical instrument as defined in claim 11, wherein each of the plurality of note interval difference signals defines a non-linear note interval difference.

13. An electronic musical instrument as defined in claim 11, wherein each of the plurality of note interval difference signals defines a linear note interval difference.

14. An electronic musical instrument comprising:

a plurality of touch-sensitive operators each having at least one designatable play position, each of the plurality of operators respectively producing, in response to a touch of the operator by a performer, a first signal indicative of a play position and a second signal indicative of an applied pressure;

tone pitch designation means, responsive to the respective first signals produced by the plurality of operators, for generating tone pitch information for each of the plurality of operators while simultaneously detecting touch of each of said plurality of operators;

tone designation means for generating tone designation information for each of said plurality of operators;

tone color selecting means, responsive to the respective second signals, for selecting a respective tone color for each of the plurality of operators and generating tone color signals indicative of the selected tone colors; and tone generation means for generating a tone signal for each of said operators in response to the tone designation information generated by said tone designation means, the respective tone pitch information corresponding to each of the plurality of operators and the tone color signals generated by the tone color selecting means, wherein said tone generation designation means comprises a plurality of tone generation designation operators each of which generates tone generation designation information in accordance with a tone generation designation operation.

15. An electronic musical instrument in accordance with claim 14, wherein each tone signal is generated in accordance with respective tone pitch information corresponding to each of said plurality of operators provided by said tone pitch designation means.

16. An electronic musical instrument in accordance with claim 14, wherein each tone color is selected in accordance with pressure applied by the performer on the plurality of touch-sensitive operators.

17. An electronic musical instrument comprising:

at least one touch-sensitive operator providing a position signal indicating a position of the operator;

a tone pitch designator responsive to each of the at least one operators generating tone pitch information based upon the position signal while simultaneously detecting touch of each of the at least one operator;

a tone generation designator providing for each of operator tone generation designation information for each of the at least one operators in accordance with a tone generation designation operation, the tone generation designator being operative independently of the tone pitch designator and the at least one touch-sensitive operator; and a tone generator responsive to each of the tone pitch information and the tone generation designation.

18. An electronic musical instrument as defined in claim 17 wherein said tone generation designator comprises a plurality of tone generation designation operators each of which generates tone generation designation information in accordance with a tone generation designation operation.

19. An electronic musical instrument as defined in claim 17 further comprising tone color setting means for setting a desired tone color for each operator, wherein each tone signal generated by said tone generation means is imparted with a tone color set by said tone color setting means for each operator.

20. An electronic musical instrument as defined in claim 17 wherein said tone pitch designator generates predetermined tone pitch information for each operator when said operators are not operated.

21. An electronic musical instrument as defined in claim 20 wherein said tone pitch designator includes tone pitch setting means for setting said predetermined tone pitch information.

22. An electronic musical instrument as claimed in claim 17 wherein said tone pitch designator comprises:

an interval information generator providing interval information corresponding to a position signal of said operator; and a reference tone pitch setter setting a reference tone pitch and generating reference tone pitch information corresponding to the set reference tone pitch, wherein the tone pitch information generator generates tone pitch information corresponding to a designated play position on said operator in accordance with the interval information from said interval information generation means and the reference tone pitch information from said reference tone pitch setting means.

23. An electronic musical instrument as defined in claim 17, further comprising:

performance operation detection means for generating load command information in response to an operation; and a storage circuit responsive to the load command information for loading and outputting the tone pitch information provided by said tone pitch designator and continuing output of the tone pitch information after the operation of said at least one position, wherein said tone generator generates at least one tone signal in response to the tone generation designation information from said tone generation designation means and continues the generation of the at least one tone signal as long as the generation of the tone generation designation information continues.

24. An electronic musical instrument as defined in claim 17 wherein each operator is capable of detecting a strength of operation at any of the designatable play positions, wherein the musical instrument further comprises information generation means for generating tone characteristic control information corresponding to the strength of the operation detected by each operator, the tone characteristic of tone signals generated by said tone generator being controlled in accordance with the tone characteristic control information provided by said information generation means.

25. An electronic musical instrument as defined in claim 17 wherein said tone generation designator is capable of detecting the strength of operation of the performance operation and said tone generator controls the tone characteristic of the tone signal in accordance with the strength of the operation detected by said tone generation designation means.

26. An electronic musical instrument as defined in claim 17, wherein the tone pitch designator generates the tone pitch information from a plurality of contiguous tone pitches based on a correspondence between the position signal and at least one of the contiguous tone pitches.

27. A method of producing a tone in response to position information, the method comprising:

generating position information using at least one touch-sensitive operator;

generating tone pitch designation information based upon the position information and simultaneous detection of touch of the at least one operator;

generating in accordance with a tone generation operation tone designation information using a tone generation designator which operates independently of the generation of tone pitch designation information and the at least one touch-sensitive operator; and producing for each operator a tone based upon the tone pitch designation information and the tone designation information.

28. A method of producing a tone as defined in claim 27, generating tone color information for each operator and imparting each tone produced for each operator a tone color based upon the tone color information.

29. A method of producing a tone as defined in claim 27, wherein the generated tone pitch information corresponds to a pitch corresponding to the position information selected from a plurality of information representing adjacent tone pitch information.

* * * * *